US012616305B1

(12) United States Patent
Longe

(10) Patent No.: US 12,616,305 B1
(45) Date of Patent: May 5, 2026

(54) LIGHTWEIGHT INFLATABLE CUSHION

(71) Applicant: Greg Longe, Reno, NV (US)

(72) Inventor: Greg Longe, Reno, NV (US)

( * ) Notice: Subject to any disclaimer, the term of this patent is extended or adjusted under 35 U.S.C. 154(b) by 0 days.

(21) Appl. No.: 19/265,467

(22) Filed: Jul. 10, 2025

Related U.S. Application Data

(63) Continuation of application No. 18/940,715, filed on Nov. 7, 2024, now Pat. No. 12,357,096.

(51) Int. Cl.

| | |
|---|---|
| ***A47C 1/16*** | (2006.01) |
| ***A47C 4/54*** | (2006.01) |
| ***A47C 7/02*** | (2006.01) |
| ***A47C 7/14*** | (2006.01) |
| ***A47C 7/46*** | (2006.01) |

(52) U.S. Cl.
CPC ..... *A47C 7/142* (2018.08); *A47C 7/021* (2013.01); *A47C 7/467* (2013.01); *A47C 1/16* (2013.01); *A47C 4/54* (2013.01)

(58) Field of Classification Search
CPC ..... A47C 4/54; A47C 7/467; A47C 27/18; A47C 1/16; A47C 7/021; A47C 7/142
USPC ..... 297/219.1
See application file for complete search history.

(56) References Cited

U.S. PATENT DOCUMENTS

| | | | | |
|---|---|---|---|---|
| 2,437,602 | A | 3/1948 | Hann | |
| 3,982,786 | A | 9/1976 | Burgin et al. | |
| 4,169,295 | A | 10/1979 | Darling | |
| 4,504,989 | A | 3/1985 | Maltz | |
| 4,897,890 | A | 2/1990 | Walker | |
| 4,991,244 | A | 2/1991 | Walker | |
| 5,277,474 | A | 1/1994 | Hannagan et al. | |
| 5,412,822 | A | 5/1995 | Kelly | |
| 5,450,638 | A | 9/1995 | Johnson | |
| 5,469,592 | A | 11/1995 | Johnson | |
| 5,558,398 | A | 9/1996 | Santos | |
| 5,638,565 | A | 6/1997 | Pekar | |
| 6,564,411 | B2 | 5/2003 | Pirzada | |
| 6,789,283 | B2 | 9/2004 | Pirzada | |
| 7,055,199 | B2 | 6/2006 | Thompson | |
| 7,437,789 | B2 | 10/2008 | Thompson | |
| 8,978,693 | B2 | 3/2015 | Frayne | |
| 9,395,007 | B2 | 7/2016 | Frayne | |
| 9,433,301 | B2 | 9/2016 | Brechet et al. | |
| 9,709,183 | B2 | 7/2017 | Frayne | |
| 11,766,961 | B2 | 9/2023 | Zhang | |
| 12,357,096 | B1 * | 7/2025 | Longe | A47C 27/081 |
| 2013/0270881 | A1 | 10/2013 | Fowler et al. | |

(Continued)

*Primary Examiner* — Rodney B White
(74) *Attorney, Agent, or Firm* — PERKINS COIE LLP; Colin M. Fowler; John Fuller

(57) ABSTRACT

An inflatable cushion that is orally inflatable using exhaled air. The inflatable cushion also can be inflated by breathing into an inflation chamber portion of the cushion and then squeezing the inflation chamber (e.g., with a user's hands and fingers), thereby increasing the pressure, to push additional air into the passages and channels to fill the seat cushion. A separate deflation chamber of the seat cushion can have a tubular check valve designed to be squeezed that opens the valve to deflate. The deflation chamber can be used to adjust the comfort of the inflatable cushion or to empty the inflatable cushion after use. The inflatable cushion can be made of thin plastic or similar material that is lightweight and can be folded, creating a structure that can be used several times before disposal.

20 Claims, 3 Drawing Sheets

(56) References Cited

U.S. PATENT DOCUMENTS

| | | | |
|---|---|---|---|
| 2014/0021755 | A1 | 1/2014 | Oates et al. |
| 2014/0232155 | A1 | 8/2014 | Bocsanyi |
| 2015/0335501 | A1 | 11/2015 | Fowler et al. |
| 2015/0369384 | A1 | 12/2015 | Frayne |
| 2016/0120332 | A1 | 5/2016 | Chou |
| 2021/0161304 | A1 | 6/2021 | Reinhard |
| 2023/0051768 | A1 | 2/2023 | Steele |
| 2023/0278477 | A1 | 9/2023 | Acome et al. |
| 2024/0188719 | A1 | 6/2024 | Liu et al. |

* cited by examiner

LIGHTWEIGHT INFLATABLE CUSHION

CROSS-REFERENCE TO RELATED APPLICATIONS

This application is a continuation of U.S. patent application Ser. No. 18/940,715, filed Nov. 7, 2024, incorporated herein by reference in its entirety.

TECHNICAL FIELD

The present invention pertains to an orally inflated plastic disposable comfort cushion.

BACKGROUND

A seat cushion can improve the comfort of a person at a locale with hard seating, such as a stadium or arena. Today, most seat cushions are constructed using a heavy, durable outside layer with a foam-filled or pump-inflated pillow inside. These foam-filled models are not adjustable and are bulky to transport or store. Many inflatable models require a pump to inflate them and, sometimes, are not allowed at event venues. Further, bringing a cushion into an event venue may not be feasible, because cushions are often bulky when folded and will not fit in small handbags.

Sometimes cushions are leased or sold at an event but can be very expensive to purchase. However, sitting on or leaning against a previously used, leased cushion may be objectionable to some people due to the cushion not being as clean as they would like, or at least due to a concern that it may not be. Additionally, some event venues will not allow purses or backpacks inside that are not clear or see-through, due to the requirement for visual inspection by security personnel.

BRIEF DESCRIPTION OF THE DRAWINGS

Detailed descriptions of implementations of the present invention will be described and explained through the use of the accompanying drawings.

Figure 1:
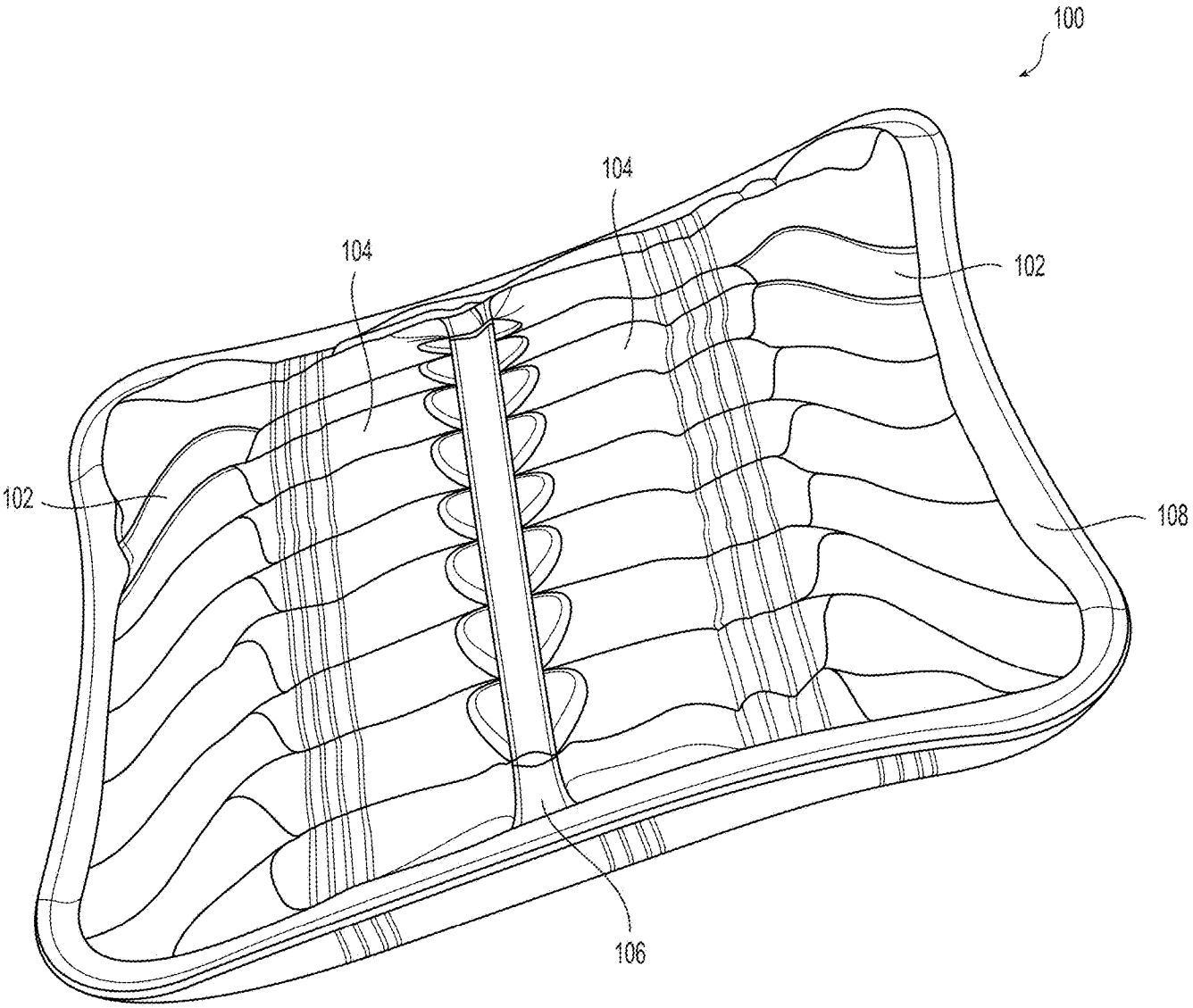
FIG. 1 illustrates a perspective view of an embodiment of a cushion.

Embodiments or implementations describing aspects of the invention are illustrated by way of example, and the same reference identifiers can indicate the same or similar elements. While the drawings depict various implementations for the purpose of illustration, those skilled in the art will recognize that alternative implementations can be employed without departing from the principles of the present technologies. Accordingly, while specific implementations are shown in the drawings, the technology is amenable to various modifications.

DETAILED DESCRIPTION

The description and associated drawings are illustrative examples and are not to be construed as limiting. This disclosure provides certain details for a thorough understanding and enabling description of these examples. One skilled in the relevant technology will understand, however, that the invention can be practiced without many of these details. Likewise, one skilled in the relevant technology will understand that the invention can include well-known structures or features that are not shown or described in detail, to avoid unnecessarily obscuring the descriptions of examples.

In view of the above-mentioned issues, a need exists for a lightweight, clear cushion that can be easily transported to a variety of different events and venues. The cushion disclosed herein is configured to support at least a portion of a person's body. In at least one embodiment, the cushion may be a seat cushion, i.e., a cushion that is designed to be sat upon by a person. The comfort of a user at any locale with hard seating, such as a stadium or arena, can be improved by using a cushion.

The disclosed cushion is a lightweight and inflatable cushion and, when not inflated, fits into most bags or pockets. The cushion, according to at least one embodiment, can provide cushioning for a user's buttocks, legs, back, or head, for example. The cushion is inflatable and includes a series of chambers and valves to provide an adjustable inflation level, enabling the user to adjust the firmness of the cushion to a desired comfort level. The cushion can be inflated orally with exhaled air from a user via an inflation chamber within the cushion. The inflation chamber facilitates the inflation of the cushion, particularly oral inflation, and makes it easier for users who may have limited breathing power (e.g., sufferers of asthma or chronic pulmonary obstructive disease (CPOD)) to inflate the cushion. The cushion can also include a deflation chamber for quickly deflating the cushion after use. The cushion can be constructed of a lightweight, thin material, such as a disposable plastic, that is strong enough to support multiple uses and inflations by the user.

Cushion

FIG. 1 illustrates a perspective view of an embodiment of the cushion 100. The cushion 100 includes multiple angled chambers 102, multiple straight chambers 104, a channel 106, and a casing 108. Using air or another gas or mixture of gases, a person (the "user") inflates the main compartment, which includes the multiple angled chambers 102 and straight chambers 104. The air can be from the user's breath or a small pump, such as a hand pump or a small electric pump. The air is transported between each angled chamber 102 and straight chamber 104 via channel 106. Channel 106 connects each angled chamber 102 and straight chamber 104 to an inflation chamber to enable air to flow to all parts of the cushion 100. The casing 108 encompasses the series of angled chambers 102, straight chambers 104, and channel 106. The casing 108 controls the size or dimensions of the cushion and prevents movement of each angled chamber 102 and straight chamber 104 relative to each other. The casing 108 can be clear or colored. In some embodiments, the casing has a design and/or text printed or embossed on it on one or both sides, such as a name and/or logo that can indicate an event, sports team, etc.

The cushion 100 can be constructed of a thin plastic material that is biodegradable and/or recyclable. For example, the plastic material can be a low-density polyethylene (LDPE). LDPE is a pliable/flexible transparent plastic material that can be manufactured to various thicknesses, which can affect the durability of the product constructed out of the material. Using a plastic material keeps the weight of the cushion 100 and construction costs low and enables disposal in common trash and/or recycling bins, such as those found in most residential homes. The entire cushion 100, including the series of angled chambers 102, straight chambers 104, channels 106, and casing 108, can be constructed from a transparent or semi-transparent material. The transparent or semi-transparent material can enable a user to bring the cushion 100 into events and venues that require visual inspection of all items by security personnel.

In some embodiments, the cushion 100 is configured to be worn like a backpack or shoulder bag. For example, the cushion may have one or more straps attached to it. When configured as a bag, the cushion 100 is constructed out of a transparent material to enable visual inspection of the cushion 100 and of any items stored in the bag. The cushion 100 can include small pockets or compartments, e.g., pockets (not shown), for storage of various items. For example, such compartments may be sized and located to allow a user to store sunblock, lotion, lip balm, cash, a credit card, and/or a water bottle. Any items stored in such compartments can be removed before the cushion is used or remain in the compartment when the compartment is located on an edge side of the cushion 100. An edge side is one of the four sides that define the inflated height of the cushion (i.e., not one of the two sides placed on either the hard surface or used to support a body part in order to provide cushioning to the user). The cushion 100 can also be configured to allow other cushions or add-ons to be attached to the cushion 100, thereby, in effect, forming one larger cushion (e.g., a full-body-sized cushion).

Figure 2:
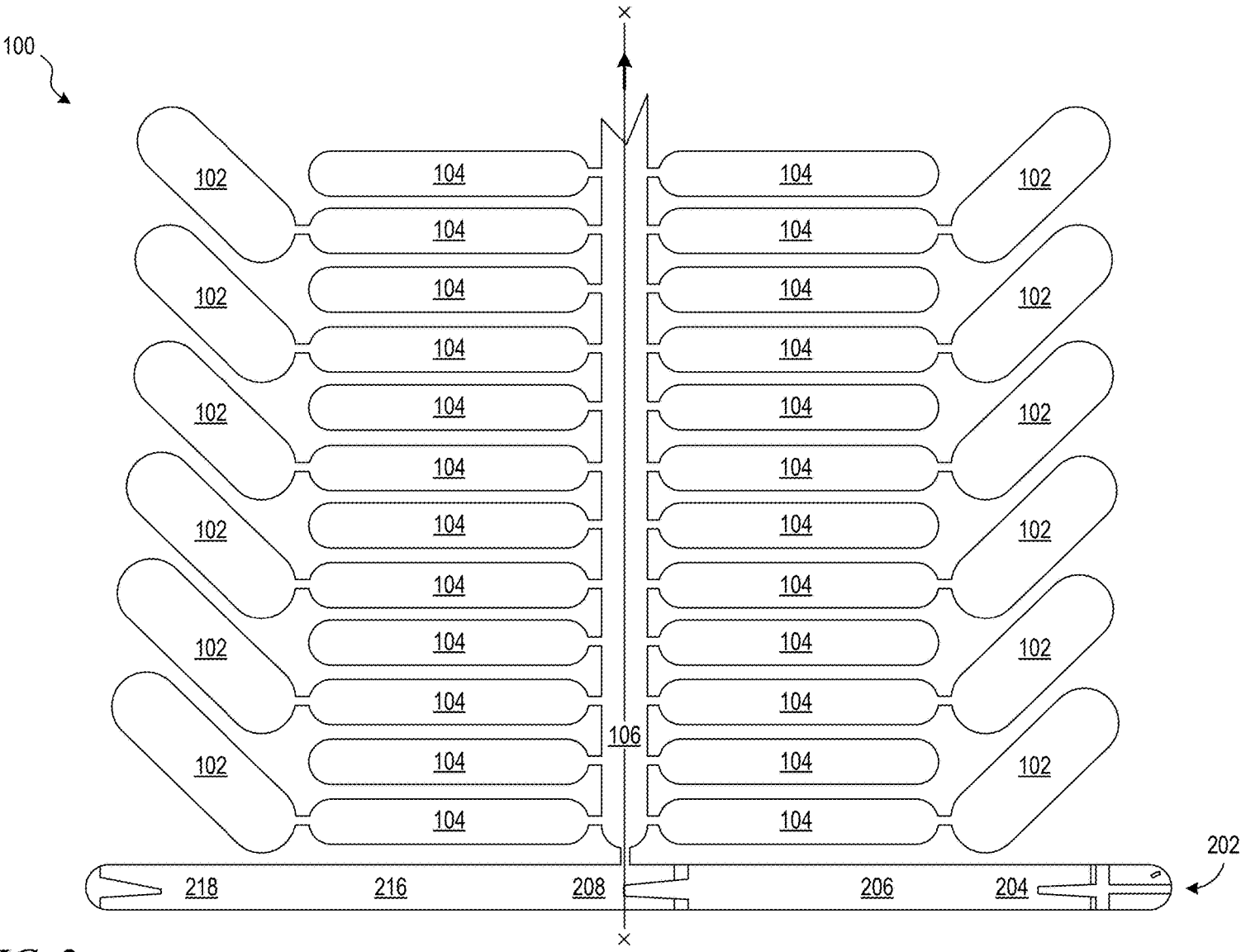
FIG. 2 illustrates a schematic view of the embodiment of the cushion of FIG. 1.

FIG. 2 illustrates a schematic diagram of an embodiment of the cushion of FIG. 1. The cushion 100 includes an inflation chamber 206, multiple straight chambers 104, multiple angled chambers 102, and a deflation chamber 216. The inflation chamber is configured to inflate the cushion 100. A user breathes air into the inflation chamber 206 using a mouthpiece 202 attached to the inflation chamber 206 at an air inlet. The air transferred into the inflation chamber 206 is directed into the multiple straight chambers 104 and multiple angled chambers 102, where the air is stored to provide cushioning. To prevent the air from escaping out of the inflation chamber 206, the cushion includes a first flat tubular check valve (check valve) 204. A check valve is a one-way valve that allows air to travel in only one direction. The check valve 204 enables a user to breathe air into the inflation chamber 206 and not have the air escape from the inflation chamber 206. A second check valve 208 is positioned between the inflation chamber 206 and the junction connecting the inflation chamber 206 to the multiple straight chambers 104, multiple angled chambers 102, and deflation chamber 216. When the user cannot solely use their breath to fully inflate or pressurize the cushion 100 to the desired firmness (e.g., due to shortness of breath), the inflation chamber 206 allows additional pressurization to be provided by the user's hands. The user breathes air into the inflation chamber 206, where the air stays between the first check valve 204 and the second check valve 208. The user then compresses (squeezes or presses on) the exterior of the inflation chamber 206 using one or both hands to overcome the pressure difference between the inflation chamber 206 and the rest of the cushion 100 and force the air past the second check valve 208. To inflate the cushion 100, the user can either first blow air into the inflation chamber and then compress the inflation chamber 206 or blow air into the inflation chamber 206 while simultaneously compressing the inflation chamber 206. The inflation chamber 206 thereby facilitates oral inflation, which is advantageous for users who may have limited breathing power (e.g., sufferers of asthma or CPOD).

After passing through the second check valve 208, the air enters channel 106. Channel 106 connects the multiple straight chambers 104 to the inflation chamber 206. Channel 106 can be positioned in the center of the cushion 100 parallel to and through axis X-X. In some embodiments, channel 106 is offset from axis X-X. The multiple straight chambers 104 extend from either side of channel 106. The number of straight chambers 104 is determined by the size of the cushion 100; for example, the larger the cushion 100, the more straight chambers 104 and subsequently angled chambers 102 there may be. The cushion 100 also includes multiple angled chambers 102. A single angled chamber 102 extends from each straight chamber 104. For example, each angled chamber 102 can be angled at 30, 45, or 60 degrees either away from or towards the inflation chamber 206. The length of each straight chamber and angled chamber determines the width of the cushion 100, while the number of straight and angled chambers determines the length of the cushion 100. The cushion 100 can be symmetrical on either side of the channel 106. The cushion 100 can be asymmetrical on either side of the channel 106 if the channel 106 is not centered on the axis X-X. In some embodiments, each straight chamber 104 is contiguous to channel 106 and each angled chamber 102. In some other embodiments, there is a small connecting passageway between each straight chamber 104 and channel 106 and each angled chamber 102. The orientation of multiple straight chambers 104 and angled chambers 102 reduces manufacturing costs while increasing comfort for the user.

The cushion 100 is deflated using the deflation chamber 216. The deflation chamber 216 includes a third check valve 218. The third check valve 218 is configured to prevent air from escaping until a user opens the third check valve 218. The user can accelerate the deflation of the cushion 100 by compressing or folding the multiple straight chambers 214 and angled chambers 102 to force the air through the third check valve 218. The deflation chamber 216 and the third check valve 218 can also allow the user to control the firmness by releasing air from the cushion 100. This enables a user to adjust the comfort level of the cushion 100 when the cushion 100 is fully inflated. The deflation chamber 216 can be the same size as the inflation chamber 206 or a different size.

The overall size or dimensions (i.e., length, width, and height) of the cushion 100 can be dependent on the cushion's 100 use case. For example, the cushion 100 can have a larger size when configured as a seat cushion or back cushion. The cushion 100 can have a smaller size when it is configured as a head cushion or feet cushion. The thickness of the cushion 100 can vary depending on the designed manner of use of the cushion 100.

Figure 3:
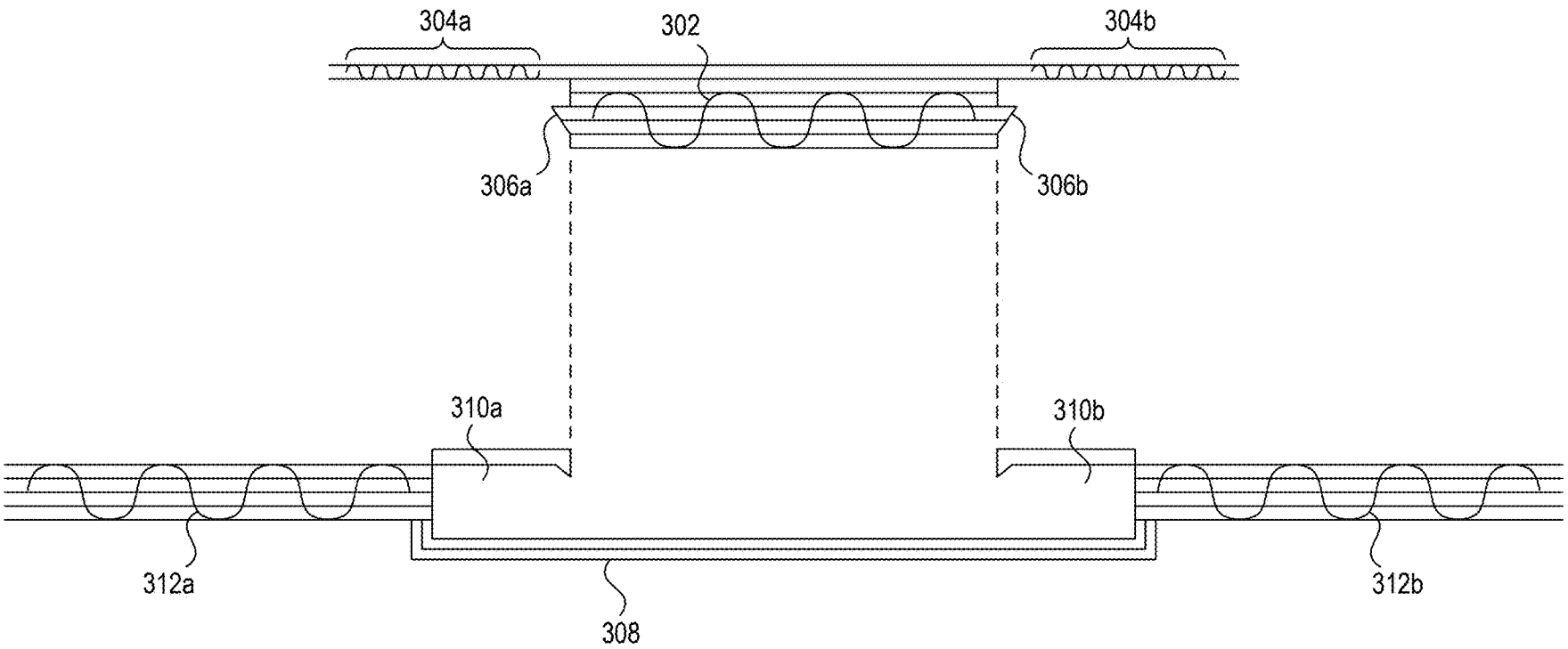
FIG. 3 illustrates an embodiment of an attachment mechanism that can be used to connect accessories to the cushion of FIG. 1.

FIG. 3 illustrates an embodiment of an attachment mechanism 300 that can be used to connect one or more accessories to the cushion 100 of FIG. 1. This attachment mechanism 300 enables a user to connect and remove accessories, such as one or more additional cushions and/or pouches for holding small items (e.g., camera, wallet, water bottle, phone, small snacks, etc.), to the cushion 100. The attachment mechanism 300 functions similarly to slide-lock closures of the type commonly used in plastic food storage bags and includes a tab portion 302 and a groove portion 308. The tab portion 302 is configured to mate with the groove portion 308. When the tab portion 302 is on the cushion 100, the groove portion 308 is on the accessory, and vice versa. The tab portion 302 is pressed into the groove portion 308 to form the connection and attach the cushion 100 to an accessory. The pressing motion forms an interlocking mechanism where the tab portion 302 fits tightly into the groove portion 308, creating a seal that can be repeatedly separated and reformed by hand. The opening of the groove portion 308 can be sized smaller than the width of the tab portion 302, so that the tab portion 302 stays connected to the groove portion 308. The groove portion 308 and the tab portion 302 can be separated by pealing the two portions apart or by applying a separating force to the attachment mechanism 300.

The tab portion 302 can include edges 306*a*, 306*b* that extend from either side of the main body of the tab portion 302. The edges 306*a*, 306*b* are configured to interlock and secure to corresponding overhangs 310*a*, 310*b* of the groove portion 308. The edges 306*a*, 306*b* fit under the overhangs 310*a*, 310*b*, which extend toward the center of the groove portion 308. The edges 306*a*, 306*b* can slightly deform to fit within the groove portion 308. The edges 306*a*, 306*b* can mate with the overhangs 310*a*, 310*b* to form the seal and the connection between the cushion 100 and an accessory. The tab portion 302 is attached to either the accessory or the cushion 100 using folded layers of heat-bonded plastic 304*a*, 304*b*. Similarly, the groove portion 308 can also be attached to either the accessory or the cushion using folded layers of heat-bonded plastic 312*a*, 312*b*. The tab portion 302 can be constructed out of folded layers of heat-bonded plastic.

The number of attachment mechanisms and the size of the attachment mechanism 300 can vary depending on the size of the cushion 100 and/or accessory. For example, a lightweight and small attachment may only require a single attachment mechanism 300 of a standard size, while a heavier or larger accessory may require multiple attachment mechanisms 300 that are one and a half to two times as large as a standard size.

I claim:

1. A seat cushion comprising:
- a main chamber that is inflatable:
- an inflation chamber separate from the main chamber and connected to the main chamber, and defined between a first one-way valve and a second one-way valve;
- a deflation chamber including a third one-way valve configured to release air from the main chamber, and
- an attachment mechanism configured to couple to at least one seat cushion accessory, the attachment mechanism including:
  - a cushion tab portion configured to couple to an accessory groove portion on the at least one seat cushion accessory.

2. The seat cushion of claim 1, wherein the cushion tab portion comprises:
- a protrusion extending from a surface of the cushion tab portion, the protrusion having an edge surface extending from the protrusion to form a seal with a corresponding surface on the accessory groove portion.

3. The seat cushion of claim 1, wherein the attachment mechanism further comprises:
- a cushion groove portion configured to couple to an accessory tab portion on the at least one seat cushion accessory.

4. The seat cushion of claim 3, wherein the cushion groove portion comprises:
- a groove extending between a first surface and a second surface, the groove having a first side, a second side opposed to the first side, and a third side between the first side and the second side; and
- a pair of overhangs including a first overhang extending from the first surface and a second overhang extending from the second surface, the pair of overhangs extending parallel to the third side between the first side and the second side of the groove.

5. The seat cushion of claim 1, wherein the at least one seat cushion accessory includes:
- a second seat cushion,
- a pouch, or
- a cup holder.

6. The seat cushion of claim 1, wherein the attachment mechanism is a first attachment mechanism, the seat cushion further comprising:
- a second attachment mechanism including a second tab portion or a second groove portion.

7. The seat cushion of claim 1, wherein the main chamber comprises:
- a plurality of straight air chambers coupled to a connecting channel,
  - wherein each straight air chamber of the plurality of straight air chambers are parallel to another and perpendicular to the connecting channel, and
  - wherein the connecting channel is coupled to the inflation chamber and the deflation chamber; and
- a plurality of angled air chambers coupled to the plurality of straight air chambers,
- wherein the plurality of angled air chambers angle away from the plurality of straight air chambers.

8. An inflatable seat cushion comprising:
- a main chamber having multiple air chambers and a connecting channel to provide adjustable cushioning to a user;
- an inflation chamber separate from the main chamber and connected to the main chamber, and defined between a first one-way valve positioned at an air inlet and a second one-way valve positioned at a connection point between the inflation chamber and the main chamber; and
- an attachment mechanism configured to couple to at least one seat cushion accessory, the attachment mechanism including:
  - a cushion tab portion that couples to an accessory groove portion on the at least one seat cushion accessory, and
    - a cushion groove portion that couples to an accessory tab portion on the at least one seat cushion accessory.

9. The inflatable seat cushion of claim 8, wherein the cushion tab portion comprises:
- a protrusion extending from a surface of the cushion tab portion, the protrusion having an edge surface extending from the protrusion to form a seal with a corresponding surface on the accessory groove portion.

10. The inflatable seat cushion of claim 8, wherein the cushion groove portion comprises:
- a groove extending between a first surface and a second surface, the groove having a first side, a second side opposed to the first side, and a third side between the first side and the second side; and
- a pair of overhangs including a first overhang extending from the first surface and a second overhang extending from the second surface, the pair of overhangs extending parallel to the third side between the first side and the second side of the groove.

11. The inflatable seat cushion of claim 8, wherein the attachment mechanism is a first attachment mechanism, the inflatable seat cushion further comprising:
- a second attachment mechanism including a second cushion tab portion or a second cushion groove portion.

12. The inflatable seat cushion of claim 8, wherein the main chamber comprises:
- a deflation chamber including a third one-way valve configured to release air from the main chamber;

a plurality of straight air chambers coupled to a connecting channel, wherein each straight air chamber of the plurality of straight air chambers are parallel to another and perpendicular to the connecting channel, and wherein the connecting channel is coupled to the inflation chamber and the deflation chamber; and a plurality of angled air chambers coupled to the plurality of straight air chambers, wherein the plurality of angled air chambers angle away from the plurality of straight air chambers.

13. The inflatable seat cushion of claim 8, wherein the at least one seat cushion accessory includes:

a second seat cushion, a pouch, or a cup holder.

14. A cushion comprising:

a main chamber configured to provide cushioning to a user using stored air:

an inflation chamber separate from the main chamber and connected to the main chamber such that a compression action applied to the inflation chamber causes an increase in pressure within the main chamber to facilitate inflation of the main chamber, wherein the inflation chamber is defined between a first one-way valve and a second one-way valve; and an attachment mechanism configured to couple to at least one seat cushion accessory, the attachment mechanism including:

a cushion groove portion configured to couple to a corresponding tab portion on the at least one seat cushion accessory.

15. The cushion of claim 14, wherein the attachment mechanism further comprises:

a cushion tab portion configured to couple to a corresponding groove portion on the at least one seat cushion accessory.

16. The cushion of claim 15, wherein the cushion tab portion comprises:

a protrusion extending from a surface of the cushion tab portion, the protrusion having an edge surface extending from the protrusion to form a seal with a corresponding surface on the corresponding groove portion of the at least one seat cushion accessory.

17. The cushion of claim 14, wherein the cushion groove portion comprises:

a groove extending between a first surface and a second surface, the groove having a first side, a second side opposed to the first side, and a third side between the first side and the second side; and a pair of overhangs including a first overhang extending from the first surface and a second overhang extending from the second surface, the pair of overhangs extending parallel to the third side between the first side and the second side of the groove.

18. The cushion of claim 14, wherein the at least one seat cushion accessory includes:

a second seat cushion, a pouch, or a cup holder.

19. The cushion of claim 14, wherein the attachment mechanism is a first attachment mechanism, the cushion further comprising:

a second attachment mechanism including a second tab portion or a second groove portion.

20. The cushion of claim 14, wherein the main chamber comprises:

a deflation chamber including a third one-way valve configured to release air from the main chamber;

a plurality of straight air chambers coupled to a connecting channel, wherein each straight air chamber of the plurality of straight air chambers are parallel to another and perpendicular to the connecting channel, and wherein the connecting channel is coupled to the inflation chamber and the deflation chamber; and a plurality of angled air chambers coupled to the plurality of straight air chambers, wherein the plurality of angled air chambers angle away from the plurality of straight air chambers.

* * * * *